US010473073B2

(12) United States Patent
Warne et al.

(10) Patent No.: US 10,473,073 B2
(45) Date of Patent: Nov. 12, 2019

(54) FUEL INJECTOR HAVING VALVE STACK WITH VENTED BACK-UP PLATE FOR CHECK SEAL RETENTION

(71) Applicant: Caterpillar Inc., Peoria, IL (US)

(72) Inventors: Derik S. Warne, Bloomington, IL (US); Michael Craig Long, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 62 days.

(21) Appl. No.: 15/915,721

(22) Filed: Mar. 8, 2018

(65) Prior Publication Data

US 2019/0277232 A1 Sep. 12, 2019

(51) Int. Cl.

| | |
|---|---|
| ***F02M 55/00*** | (2006.01) |
| ***F02M 59/46*** | (2006.01) |
| ***F02M 61/04*** | (2006.01) |
| ***F02M 59/02*** | (2006.01) |
| ***F02M 51/06*** | (2006.01) |
| ***F02M 61/18*** | (2006.01) |
| ***F02M 61/20*** | (2006.01) |

(52) U.S. Cl.

CPC ..... *F02M 55/002* (2013.01); *F02M 51/061* (2013.01); *F02M 55/004* (2013.01); *F02M 59/027* (2013.01); *F02M 59/46* (2013.01); *F02M 61/04* (2013.01); *F02M 61/18* (2013.01); *F02M 61/1806* (2013.01); *F02M 61/20* (2013.01)

(58) Field of Classification Search

CPC .. F02M 55/002; F02M 55/004; F02M 59/027; F02M 59/46; F02M 61/04; F02M 57/02; F02M 61/18; F02M 61/20; F02M 61/1806; F02M 51/061

USPC ..... 239/88, 96, 533.2, 533.3, 533.8, 533.9, 239/533.12, 584, 585.1, 590, 590.5

See application file for complete search history.

(56) References Cited

U.S. PATENT DOCUMENTS

| | | | | |
|---|---|---|---|---|
| 5,390,851 | A * | 2/1995 | Long | F02M 57/024 239/88 |
| 5,797,427 | A | 8/1998 | Buescher | |
| 6,390,385 | B1 * | 5/2002 | Hardy | F02M 55/002 239/88 |
| 8,690,075 | B2 | 4/2014 | Mahmood et al. | |
| 2004/0056117 | A1 * | 3/2004 | Wang | F02M 47/027 239/585.1 |
| 2012/0103308 | A1 | 5/2012 | Hefler | |
| 2013/0119162 | A1 * | 5/2013 | Morris | F02M 63/0215 239/533.9 |

FOREIGN PATENT DOCUMENTS

| | | | |
|---|---|---|---|
| CN | 106402241 | A | 2/2017 |
| WO | 2003083335 | A1 | 10/2003 |
| WO | 2011034806 | A1 | 3/2011 |

* cited by examiner

*Primary Examiner* — Steven J Ganey

(74) *Attorney, Agent, or Firm* — Jonathan F. Yates

(57) ABSTRACT

A fuel injector includes a valve stack forming a seal cavity, and an outlet check extending through the seal cavity. A check seal is positioned within the seal cavity and seals about the outlet check. The valve stack also includes a back-up plate trapping the check seal within the seal cavity, such that a crevice is formed within the seal cavity between the check seal and the back-up plate. The back-up plate has a vent formed therein that fluidly connects the crevice to a drain.

20 Claims, 3 Drawing Sheets

FUEL INJECTOR HAVING VALVE STACK WITH VENTED BACK-UP PLATE FOR CHECK SEAL RETENTION

TECHNICAL FIELD

The present disclosure relates generally to a fuel injector, and more particularly to a valve stack in a fuel injector having a vented back-up plate trapping a check seal.

BACKGROUND

Fuel systems used in state-of-the-art internal combustion engines tend to be relatively complex. The associated engines can be direct-injected where a fuel injector is positioned at least partially within an engine cylinder, port injected where fuel is delivered into a port in communication with an engine cylinder, or structured according to yet another strategy where fuel is delivered at a location upstream of an engine cylinder into an intake runner or an intake manifold, or for some gaseous fuel engines, delivered upstream a compressor of a turbocharger.

In the case of compression ignition diesel engines it is typical for liquid fuel injection pressures to be as high as several hundred megaPascals (MPa). Injections can occur multiple times per second, necessitating rapid travel of moving parts within the fuel injector in response to electromagnetic actuation forces and/or rapid pressure changes, and resulting in relatively intense, repetitive impacts, and in some instances a tendency toward liquid cavitation. The timing and manner of injection of fuel is typically relatively tightly controlled, with opening and closing of valves desirably quite rapid to produce so-called "square" injection rate shapes. Pressurization of the fuel to be injected can take place within the fuel injector itself, such as by way of a hydraulically actuated or cam-actuated piston, or in a common rail or related system where a common reservoir of highly pressurized fuel is maintained for multiple fuel injectors.

Performance analysis and fault detection in fuel systems can be challenging, given a relatively great number of moving parts, harsh conditions, and still other factors. One example fuel injector for an internal combustion engine is known from U.S. Pat. No. 8,690,075.

SUMMARY OF THE INVENTION

In one aspect, a fuel injector includes an injector body defining a longitudinal center axis extending between a first injector body end and a second injector body end including a nozzle with a plurality of spray orifices formed therein. The fuel injector further includes a valve stack positioned within the injector body and forming a check guide, a seal cavity in fluid communication with the check guide, and a drain. The fuel injector further includes an outlet check extending through the check guide and the seal cavity, the outlet check being guided within the valve stack by way of the check guide between an advanced position where the outlet check blocks the plurality of spray orifices, and a retracted position. A check seal is positioned within the seal cavity and is in sealing contact with the outlet check. The valve stack further includes a back-up plate trapping the check seal within the seal cavity, such that a crevice is formed within the seal cavity between the check seal and the back-up plate. The back-up plate has a vent formed therein that fluidly connects the crevice to the drain.

In another aspect, a valve stack assembly for a fuel injector includes a plurality of coaxially arranged valve stack pieces positionable within a fuel injector body and including a check guide piece, a piston guide piece, and a back-up plate positioned axially between the check guide piece and the piston guide piece. An outlet check is movable within the valve stack between an advanced position and a retracted position, for opening and closing a plurality of spray orifices formed in the fuel injector body. The valve stack assembly further includes a check seal positioned in sealing contact with the outlet check. The check guide piece forms a check guide that guides the outlet check between the advanced position and the retracted position, and the piston guide piece forms a drain for draining fluid displaced during movement of the outlet check within the valve stack between an advanced position and a retracted position. The check guide piece and the back-up plate together define a seal cavity receiving the check seal, and the valve stack further includes a back-up plate trapping the check seal within the seal cavity, such that a crevice is formed within the seal cavity between the check seal and the back-up plate. The back-up plate further includes a vent formed therein that fluidly connects the crevice to the drain.

In still another aspect, a back-up plate for trapping a check seal in a valve stack assembly of a fuel injector includes a disc-shaped plate body having an outer perimetric edge, and an inner perimetric edge, the inner perimetric edge defining a central aperture structured to receive an outlet check in the fuel injector and defining a longitudinal center axis extending between a first plate body side and a second plate body side. The disc-shaped plate body further has formed therein a plurality of dowel holes and a plurality of fuel holes, and the plurality dowel holes and the plurality of fuel holes are arranged in a trapezoidal pattern. The disc-shaped plate body further has a chamfer located on the first plate body side and extending radially and axially outward from the inner perimetric edge, and a vent extending between the first plate body side and the second plate body side. The vent includes a plurality of vent holes, at least a majority of which are positioned within the trapezoidal pattern, structured for venting a fluid pressure from a crevice formed between the check seal and the back-up plate in the valve stack assembly.

DETAILED DESCRIPTION

Figure 1:
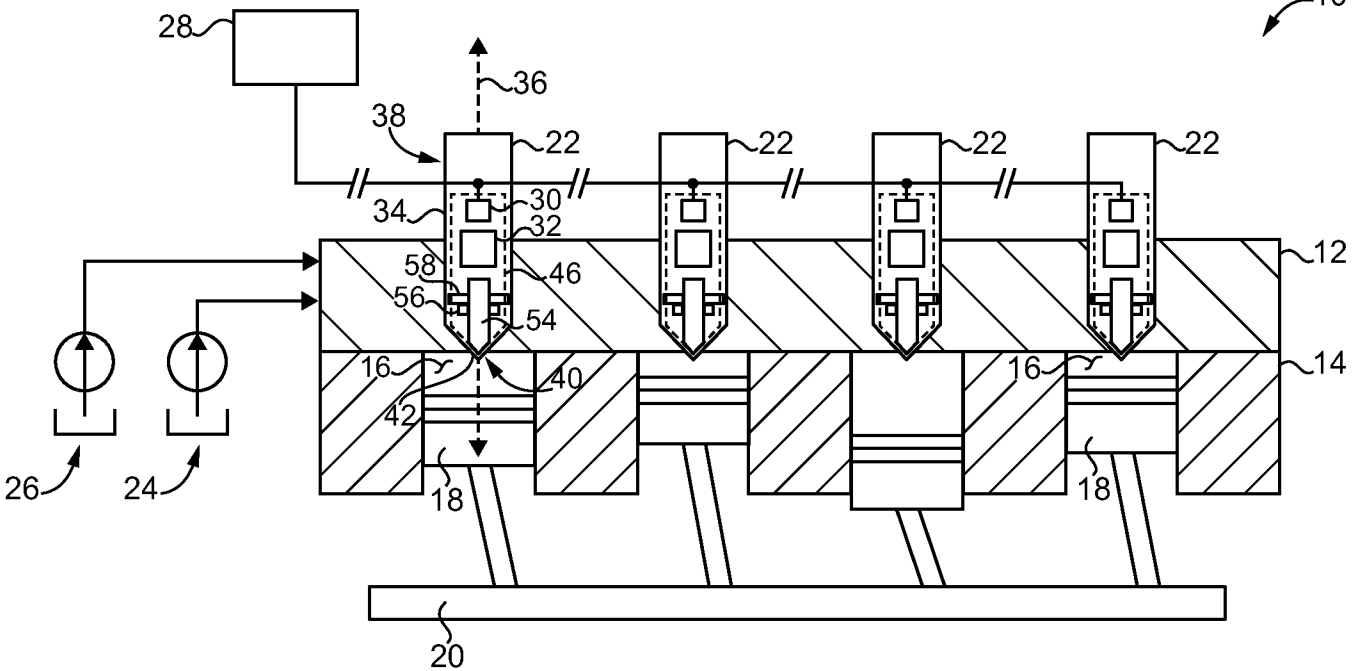
FIG. 1 is a partially sectioned side diagrammatic view of an engine system, according to one embodiment.

Referring to FIG. 1, there is shown an internal combustion engine system 10 according to one embodiment. Internal combustion engine system 10 (hereinafter "engine system 10") can include a compression ignition diesel engine system having an internal combustion engine 12 with an engine housing 14 in a generally conventional manner. Engine housing 14 includes a plurality of cylinders 16 formed therein and arranged in any suitable configuration such as a V-configuration, an in-line configuration, or still another. A plurality of pistons 18 are provided and each positioned to reciprocate within one of cylinders 16, to rotate a crankshaft 20. Engine system 10 also includes a plurality of fuel injectors 22 each coupled with a fuel supply 24 and an oil supply 26. Each of fuel supply 24 and oil supply 26 can convey the corresponding fuel or oil to (and potentially from) each fuel injector 22 by way of conduits (not shown) formed at least partially within engine housing 14. Fuel might be supplied at a relatively low pressure to fuel injectors 22, and then increased in pressure to an injection pressure within each individual fuel injector 22. A so-called unit pump might be coupled with, positioned in, or otherwise associated with each fuel injector 22 and operated by way of an engine cam (not shown). Alternatively, fuel may be pressurized to an injection pressure and maintained at or close to injection pressure in a common pressure reservoir such as a common rail. It has been observed that in some instances failure or degradation of components within fuel injectors can cause mixing of fuel and oil, reduced performance, or other problems. As will be further apparent from the following description, each fuel injector 22 and engine system 10 may be structured to mitigate degradation or failure of an internal seal to reduce or prevent various undesired outcomes.

Each fuel injector 22 may further include an electrical actuator 30, and a valve assembly 32 controlled by electrical actuator 30 and adjustable between or among a plurality of states to control the start and end timing of fuel injection and, depending upon the implemented design, potentially also pressurization of fuel within each fuel injector 22. An electronic control unit or ECU 28 may be in control communication with each electrical actuator 30. It should be appreciated that each fuel injector 22 may be substantially identical, or otherwise have analogously configured components, and therefore description herein of any one of fuel injectors 22 in the singular and description of the constituent parts, features and components of any one of fuel injectors 22, will be understood by way of analogy to refer to any of the other fuel injectors 22 in engine system 10. Each fuel injector 22 includes an injector body 34 defining a longitudinal center axis 36 extending between a first injector body end 38 and a second injector body end 40. A fuel inlet is shown at 49. An oil inlet/outlet or oil drain is shown at 52. Second injector body end 40 includes a nozzle 42 that extends into a corresponding one of cylinders 16. At an appropriate timing the corresponding electrical actuator 30 can be operated to adjust the corresponding valve assembly 32 to cause an outlet check 54 to move between an advanced position and a retracted position to control fuel injection, as further discussed herein. In an implementation where fuel is pressurized for injection within fuel injector 22, valve assembly 32 could be operated by way of energizing and/or de-energizing electrical actuator 30, or another electrical actuator, to convey hydraulically-pressurized or cam-pressurized fuel to outlet check 54.

Figure 2:
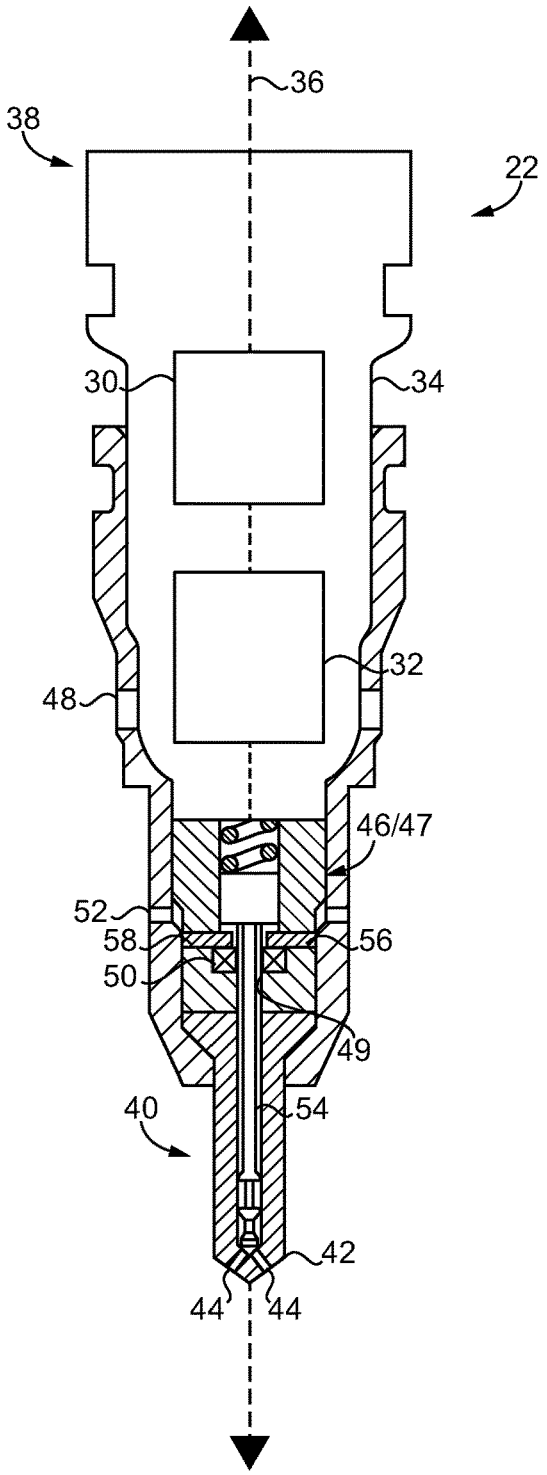
FIG. 2 is a partially sectioned side diagrammatic view of a fuel injector suitable for use in the engine system of FIG. 1.

Referring also now to FIG. 2, there is shown a fuel injector 22 in further detail. It can be seen that nozzle 42 has a plurality of spray orifices 44 formed therein. When outlet check 54 is at its advanced position, outlet check 54 blocks spray orifices 44, whereas when outlet check 54 is at its retracted position spray orifices 44 are open. Fuel inlet 49 receives a flow of fuel, either at an injection pressure, or at a lower pressure yet to be increased within fuel injector 22 to an injection pressure, and conveys the fuel to outlet check 54. It will also be appreciated that certain passages within fuel injector 22 are omitted from the illustration of FIG. 2 for clarity, but can include a nozzle supply passage that extends between valve assembly 32 and spray orifices 44 in a generally known manner. Fuel injector 22 also includes a valve stack 46 in a valve stack assembly 47 that is positioned within injector body 34.

Figure 3:
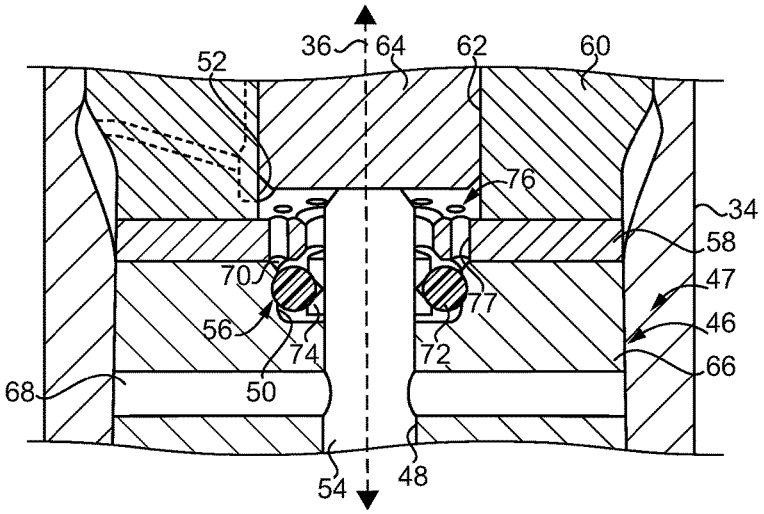
FIG. 3 is a sectioned side view showing a portion of the fuel injector of FIG. 2.

Referring also now to FIG. 3, valve stack 46 forms a check guide 48. Outlet check 54 extends through check guide 48. Valve stack 46 also forms a seal cavity 50 in fluid communication with check guide 48, and a drain 52. Outlet check 54 can be seen to extend through check guide 48 and through seal cavity 50, and is guided within valve stack 46 by way of check guide 48 between the advanced position where outlet check 54 blocks spray orifices 44, and the retracted position where outlet check 54 does not block spray orifices 44. Fuel injector 22 may further include a non-metallic check seal 56 positioned within seal cavity 50 and in sealing contact with outlet check 54. Valve stack 46 further includes a metallic back-up plate 58 trapping check seal 56 within seal cavity 50, and such that a crevice 70 is formed within seal cavity 50 between check seal 56 and back-up plate 58. Back-up plate 58 further includes a vent 76 formed therein that fluidly connects crevice 70 to drain 52.

In the illustrated embodiment crevice 70 is annular and extends circumferentially around longitudinal center axis 36. As illustrated, vent 76 can include a plurality of vent holes 77. Vent holes 77 can include circular vent holes distributed circumferentially around longitudinal center axis 36 and arranged in a circular pattern. In an alternative embodiment, rather than a circular shape, vent holes 77 might be arcuate, have the form of slots, ovals, or still another shape. Moreover, depending upon the application, injector design, and operating conditions, vent 76 might include a greater number of vent holes, a smaller number of vent holes, or a different distribution of vent holes than that disclosed herein. For instance, while in a practical implementation strategy vent holes 77 have a circumferential and regular distribution, in other instances a distribution of vent holes 77 might be non-regular or only partially about longitudinal center axis 36. Vent holes 77 can further include a diameter that is about 1.0 mm or less, more particularly about 0.6 mm, however, in other embodiments vent holes 77 might be relatively larger or relatively smaller. It can further be seen that outlet check 54 extends through check guide 48. A relatively tight guide clearance may be formed by check guide 48 and outlet check 54. An enlarged clearance, further discussed herein, may be formed between outlet check 54 and back-up plate 58. It can also be noted from FIG. 3 that valve stack 46 includes a plurality of coaxially arranged valve stack additional pieces, namely, a piston guide piece 60 forming a piston guide 62 and having a piston 64 that is in contact with outlet check 54 positioned therein. A check guide piece 66 may form check guide 48, and back-up plate 58 may be sandwiched between piston guide piece 60 and check guide piece 66, such that seal cavity 50 is formed in part by each of check guide piece 66 and back-up plate 58. It can further be seen that seal cavity 50 extends circumferentially around outlet check 54. Check seal 56 can include a sealing sleeve 74 which could be formed from polytetrafluoroethylene (PTFE) providing the sealing contact with outlet check 54, and a seal energizer 72 such as a rubber O-ring. Seal energizer 72 may be radially compressed between sealing sleeve 74 and check guide piece 66. The relative proportions and sizes in FIG. 3 are approximate only. Crevice 70 may be defined in part by each of check guide piece 66, back-up plate 58, and seal energizer 72.

Check piston 64 can be spring biased to contact outlet check 54 and maintain outlet check 54 in its advanced position to block spray orifices 44. When a closing hydraulic pressure upon a top side (not numbered) of check piston 64 is relieved, opening hydraulic pressure on opening hydraulic surfaces (not numbered) of outlet check 54 can cause outlet check 54 to lift from its advanced position to open spray orifices 44. It can be seen that check piston 64 and outlet check 54 will generally move together along longitudinal center axis 36. It can further be noted that check piston 64 has an axial footprint, and vent holes 77 are arranged within the axial footprint.

Figure 4:
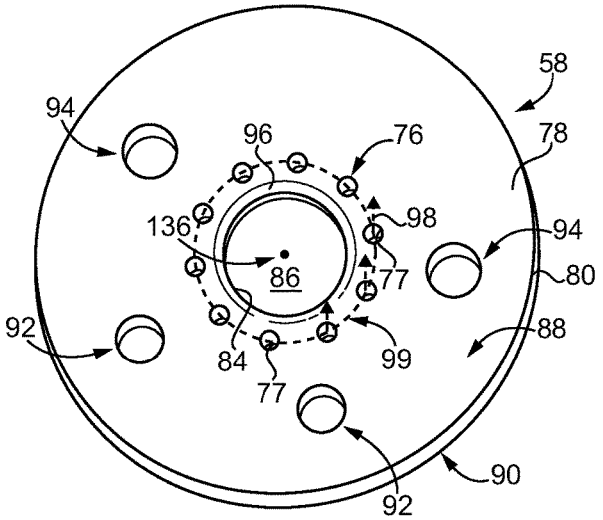
FIG. 4 is a perspective view of a back-up plate for a valve stack in a fuel injector, according to one embodiment.

Referring now to FIG. 4, there is shown a perspective view of back-up plate 58, illustrating additional details. It can be seen that back-up plate 58 is formed by a disc-shaped plate body 78 having an outer perimetric edge 80, and an inner perimetric edge 84. Inner perimetric edge 84 defines a central aperture 86 structured for receiving outlet check 54 in fuel injector 22, with central aperture 86 defining a longitudinal center axis 136 extending between a first plate body side 88 and a second plate body side 90. Axes 36 and 136, and a longitudinal center axis of valve stack 46 can all be collinear. Disc-shaped plate body 78 further has formed therein a plurality of dowel holes 92 and a plurality of fuel holes 94. Dowel holes 92 may be structured to receive dowels to locate back-up plate 58 within valve stack 46 and valve stack assembly 47, fuel holes 94 can provide fuel passages for conveying fuel through valve stack 46 to be pressurized or to be supplied at injection pressure to spray orifices 44. Dowel holes 92 and fuel holes 94 can be arranged in a trapezoidal pattern approximately as shown in FIG. 4. As noted above, vent 76 can include a plurality of vent holes 77. Vent holes 77 may each define a vent hole center axis 98, with vent holes 77 being arranged upon a common circle 99 that is intersected by vent hole center axes 98. Circle 99 may be centered on longitudinal center axis 136, and located radially between central aperture 86 and each of dowel holes 92 and fuel holes 94. The trapezoidal pattern may overlap the circular pattern formed by vent holes 77, with at least a majority of vent holes 77 positioned within the trapezoidal pattern defined by dowel holes 92 and fuel holes 94.

Figure 5:
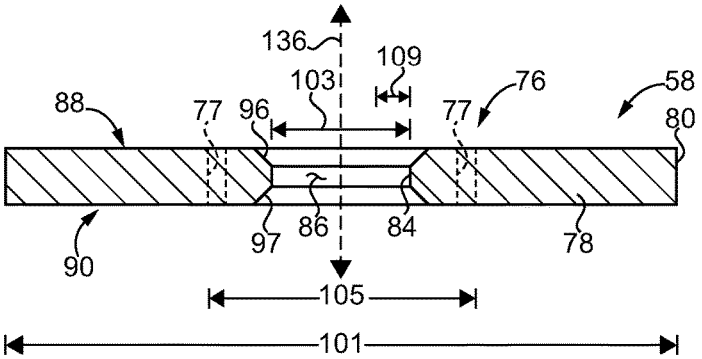
FIG. 5 is a sectioned side view through the back-up plate.

Referring now to FIG. 5, there is shown a sectioned view through back-up plate 58, illustrating still further details. Back-up plate 58 may have a plate diameter 101 from about 15 millimeters to about 17 millimeters. Central aperture 86 may have an aperture diameter 103 from about 3.0 millimeters to about 3.7 millimeters. Common circle 99 may have a circle diameter 105 from about 6 millimeters to about 7 millimeters. It can also be seen that plate body 78 has a chamfer 96 located on first plate body side 88 and extending radially and axially outward from inner perimetric edge 84. Vent 76 formed by vent holes 77 extends axially between first plate body side 88 and second plate body side 90. Another chamfer 97 may be located on second plate body side 90 and is substantially a mirror image of chamfer 96.

Figure 6:
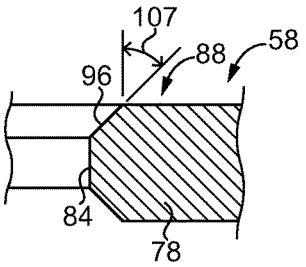
FIG. 6 is an enlarged sectioned view through a portion of the back-up plate of FIG. 5.

Referring also to FIG. 6, in an implementation, chamfer 96 has a chamfer angle 107 from about 45 degrees to about 55 degrees. Chamfer 96 may also be understood to adjoin central aperture 86, and faces an axial direction of first injector body end 38. FIG. 5 also illustrates a clearance 109. It will be recalled that a relatively tight guide clearance is formed between outlet check 54 and check guide 48, and an enlarged clearance is formed between outlet check 54 and back-up plate 58. Enlarged clearance 109 shown in FIG. 5 corresponds to that enlarged clearance discussed above. In an implementation, enlarged clearance 109 may be from about 0.4 millimeters to about 0.7 millimeters. The term "about" may be understood herein in the context of conventional rounding to a consistent number of significant digits. Accordingly, "about 15 millimeters" can be understood to be from 14.5 millimeters to 15.4 millimeters. Analogously, "about 3.7 millimeters" can be understood to be from 3.65 millimeters to 3.74 millimeters, and so on.

INDUSTRIAL APPLICABILITY

Referring to the drawings generally, but in particular back to FIG. 3, there can be seen a passage 68 that provides a fluid communication pathway to and around outlet check 54. During operation there can be a tendency for fuel to migrate up between check guide piece 66 and check guide 48 and/or from passage 68 toward check seal 56. Check seal 56 keeps upwardly migrating fuel from making its way up into and around components such as the top end of outlet check 54, check piston 64, and back-up plate 58 that are normally bathed in oil, such as engine oil. It will be recalled, however, that fuel injector 22 presents a relatively dynamic and harsh environment. With outlet check 54 and check piston 64 moving up and down relatively rapidly and frequently, pressure changes can be relatively rapid and intense. In earlier strategies, a backup plate was used to trap a check seal, but did so in such a way and with such a design that a crevice formed between the check seal and the back-up plate created a pocket of fluid that did not communicate with any larger fluid volume and/or with a low pressure space. For this and potentially other reasons it is believed that pressures and/or pressure changes during fuel injector operation resulted in cavitation or other erosive phenomena that damaged or degraded the check seal, particularly in or near the areas exposed to the trapped fluid in the crevice. According to the present disclosure, a number of differences over earlier strategies mitigate and potentially eliminate such erosive phenomena. In particular, enlarged clearance 109, chamfer 96, and vent 76 are believed to bias the creation or production of cavitation phenomena away from the check seal area, whilst also providing fluid communication between crevice 70 and drain 52. Cavitation that does occur will tend to be near or near enough to chamfer 96 that any erosive phenomena that does occur will not affect check seal 56. Vent 76 provides a pathway for communicating pressures or pressure changes of crevice 70 to drain 52.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an injector body defining a longitudinal center axis extending between a first injector body end and a second injector body end including a nozzle with a plurality of spray orifices formed therein;

a valve stack positioned within the injector body and forming a check guide, a seal cavity in fluid communication with the check guide, and a drain;

an outlet check extending through the check guide and the seal cavity, the outlet check being guided within the valve stack by way of the check guide between an advanced position where the outlet check blocks the plurality of spray orifices, and a retracted position;

a check seal positioned within the seal cavity and in sealing contact with the outlet check;

the valve stack further including a back-up plate trapping the check seal within the seal cavity, such that a crevice is formed within the seal cavity between the check seal and the back-up plate; and the back-up plate having a vent formed therein that fluidly connects the crevice to the drain.

2. The fuel injector of claim 1 wherein the outlet check extends through the back-up plate, and wherein a guide clearance is formed between the outlet check and the check guide and an enlarged clearance is formed between the outlet check and the back-up plate.

3. The fuel injector of claim 2 wherein the crevice is annular and extends circumferentially around the longitudinal center axis, and the vent includes a plurality of vent holes distributed circumferentially around the longitudinal center axis.

4. The fuel injector of claim 3 wherein the plurality of vent holes are arranged in a circular pattern.

5. The fuel injector of claim 4 wherein the back-up plate has formed therein a plurality of dowel holes and a plurality of fuel holes, and the plurality of dowel holes and the plurality of fuel holes are arranged in a trapezoidal pattern that overlaps the circular pattern.

6. The fuel injector of claim 3 wherein the valve stack further includes a piston guide piece forming a piston guide, and a check guide piece forming the check guide, and the back-up plate is sandwiched between the piston guide piece and the check guide piece and the seal cavity is formed in part by each of the check guide piece and the back-up plate.

7. The fuel injector of claim 6 wherein the seal includes a sealing sleeve providing the sealing contact with the outlet check, and a seal energizer compressed between the sealing sleeve and the check guide piece, and wherein the crevice is defined in part by each of the check guide piece, the back-up plate, and the seal energizer.

8. The fuel injector of claim 6 further comprising a check piston within the piston guide piece and having an axial footprint, and wherein the plurality of vent holes are arranged within the axial footprint.

9. The fuel injector of claim 2 wherein the back-up plate includes a chamfer adjoining the central aperture and facing an axial direction of the first injector body end.

10. A valve stack assembly for a fuel injector comprising:

a plurality of coaxially arranged valve stack pieces positionable within a fuel injector body and including a check guide piece, a piston guide piece, and a back-up plate positioned axially between the check guide piece and the piston guide piece;

an outlet check movable within the valve stack between an advanced position and a retracted position, for opening and closing a plurality of spray orifices formed in the fuel injector body;

a check seal positioned in sealing contact with the outlet check;

the check guide piece forming a check guide that guides the outlet check between the advanced position and the retracted position, and the piston guide piece forming a drain for draining fluid displaced during movement of the outlet check within the valve stack between an advanced position and a retracted position;

the check guide piece and the back-up plate together defining a seal cavity receiving the check seal, and the valve stack further including a back-up plate trapping the check seal within the seal cavity, such that a crevice is formed within the seal cavity between the check seal and the back-up plate; and the back-up plate having a vent formed therein that fluidly connects the crevice to the drain.

11. The valve stack assembly of claim 10 wherein the valve stack assembly defines a longitudinal center axis, and wherein the crevice is annular and extends circumferentially around the longitudinal center axis, and the vent includes a plurality of vent holes distributed circumferentially around the longitudinal center axis.

12. The valve stack assembly of claim 11 wherein the plurality of vent holes are arranged in a circular pattern defining a common circle centered on the longitudinal center axis.

13. The valve stack assembly of claim 12 wherein the outlet check extends through the back-up plate, and wherein a guide clearance is formed between the outlet check and the check guide and an enlarged clearance is formed between the outlet check and the back-up plate.

14. The valve stack assembly of claim 13 wherein the back-up plate has a central aperture forming the enlarged clearance, and a chamfer adjoining the central aperture.

15. The valve stack assembly of claim 13 wherein the central aperture has an aperture diameter from about 3.0 millimeters to about 3.7 millimeters, and the enlarged clearance is from about 0.4 millimeters to about 0.7 millimeters.

16. The valve stack assembly of claim 15 wherein the back-up plate has a plate diameter from about 15 millimeters to about 17 millimeters, and wherein the common circle has a circle diameter from about 6 millimeters to about 7 millimeters and the chamfer has a chamfer angle from about 45 degrees to about 55 degrees.

17. The valve stack assembly of claim 15 wherein:

the check seal includes a sealing sleeve providing the sealing contact with the outlet check, and a seal energizer compressed between the sealing sleeve and the check guide piece;

the crevice has an annular shape and is defined in part by each of the check guide piece, the back-up plate, and the seal energizer.

18. A back-up plate for trapping a check seal in a valve stack assembly of a fuel injector comprising:

a disc-shaped plate body having an outer perimetric edge, and an inner perimetric edge, the inner perimetric edge defining a central aperture structured for receiving an outlet check in the fuel injector and defining a longitudinal center axis extending between a first plate body side and a second plate body side;

the disc-shaped plate body further having formed therein a plurality of dowel holes and a plurality of fuel holes, and the plurality of dowel holes and the plurality of fuel holes are arranged in a trapezoidal pattern;

the disc-shaped plate body further having a chamfer located on the first plate body side and extending radially and axially outward from the inner perimetric edge, and a vent extending between the first plate body side and the second plate body side; and the vent including a plurality of vent holes, at least a majority of which are positioned within the trapezoidal pattern, structured for venting a fluid pressure from a crevice formed between the check seal and the back-up plate in the valve stack assembly.

19. The back-up plate of claim 18 wherein the plurality of vent holes are circular and define center axes arranged on a common circle centered on the longitudinal center axis and located radially between the central aperture and each of the plurality of dowel holes and the plurality of fuel holes.

20. The back-up plate of claim 18 wherein:

the back-up plate has a plate diameter from about 15 millimeters to about 17 millimeters;

the central aperture has an aperture diameter from about 3.0 millimeters to about 3.7 millimeters; and the common circle has a circle diameter from about 6 millimeters to about 7 millimeters; and the chamfer has a chamfer angle from about 45 degrees to about 55 degrees.

* * * * *